US006442791B1

(12) United States Patent
McRae Thomson et al.

(10) Patent No.: US 6,442,791 B1
(45) Date of Patent: Sep. 3, 2002

(54) VACUUM CLEANER

(75) Inventors: Andrew Walter McRae Thomson, Avening; Peter David Gammack, Bath; James Dyson, Little Somerford, all of (GB)

(73) Assignee: Dyson Limited, Wiltshire (GB)

( * ) Notice: Subject to any disclaimer, the term of this patent is extended or adjusted under 35 U.S.C. 154(b) by 0 days.

(21) Appl. No.: 09/806,919

(22) PCT Filed: Oct. 4, 1999

(86) PCT No.: PCT/GB99/03268

§ 371 (c)(1),
(2), (4) Date: Apr. 6, 2001

(87) PCT Pub. No.: WO00/21424

PCT Pub. Date: Apr. 20, 2000

(30) Foreign Application Priority Data

Oct. 8, 1998 (GB) ..... 9822004

(51) Int. Cl.[7] ..... A47L 5/32
(52) U.S. Cl. ..... 15/334; 15/352
(58) Field of Search ..... 15/331, 334, 352

(56) References Cited

U.S. PATENT DOCUMENTS 4,011,624 A * 3/1977 Proett ..... 15/344
5,355,549 A * 10/1994 Steinberg et al. ..... 15/334
5,388,303 A * 2/1995 Hemmann et al. ..... 15/334
6,295,694 B1 * 10/2001 Dyson et al. ..... 15/334

FOREIGN PATENT DOCUMENTS

GB 2 321 393 A 7/1998
GB 2 321 589 A 8/1998

* cited by examiner

*Primary Examiner*—Chris K. Moore
(74) *Attorney, Agent, or Firm*—Morrison & Foerster LLP

(57) ABSTRACT

The invention provides a vacuum cleaner having a dirty air inlet, a clean air outlet and dirt and dust separating apparatus lying in an air flow path therebetween, wherein the air flow path has a substantially uniform cross-sectional area between the dirty air inlet and the separating apparatus and between the separating apparatus and the clean air outlet. The uniformity of the cross-sectional area reduces frictional losses and reduces pressure drops within the cleaner. Some portions of the air flow path are preferably removable from the cleaner to allow access for maintenance and removal of blockages.

15 Claims, 3 Drawing Sheets

VACUUM CLEANER

This application claims priority to International Application No. PCT/GB99/03268 which was published on Apr. 20, 2000.

TECHNICAL FIELD OF THE INVENTION

The invention relates to a vacuum cleaner. Particularly, but not exclusively, the invention relates to an upright vacuum cleaner.

BACKGROUND OF THE INVENTION

An upright vacuum cleaner generally has a cleaner head rotatably mounted on the lower end of a main body in which dust separation apparatus is housed. The dust separation apparatus can be in the form of a conventional bag filter or in the form of a cyclonic separator consisting of one or two cyclones as shown and described in, for example, EP 0 042 723. A handle for propelling the cleaner across the floor to be cleaned is arranged to extend upwardly from or behind the main body. A pair of supporting wheels are mounted on the lower end of the main body or on the cleaner head. The cleaner head extends in a forward direction. A dirty-air inlet is located at the forward end of the cleaner head and facing downwardly so that, in use, the dirty-air inlet faces towards the surface to be cleaned. Dirty air is drawn into the dust separation apparatus via the dirty-air inlet by means of a fan driven by a motor. It is conducted to the dust separation apparatus by a first air flow path. When the dirt and dust entrained within the air has been separated from the airflow in the separating apparatus, clean air is conducted to the clean air outlet via a second air flow path and expelled into the atmosphere.

Upright vacuum cleaners are commonly convertible into cylinder cleaners. In the cylinder mode, the dirty air is drawn into the cleaner by way of a wand or hose attached to the vacuum cleaner instead of by way of the dirty air inlet located in the cleaner head. This cylinder mode facilitates cleaning of areas which cannot be easily reached by the cleaner head, for example, underneath furniture, on stairs or above the floor. The handle which is used to propel the vacuum cleaner across the floor in the upright mode is in some cases convertible into a wand and hose arrangement for this purpose. In either mode, the air which is drawn into the machine has to travel along an air flow path of significant length before being expelled to the atmosphere.

In the known prior art, the air flow path changes in cross-sectional size and shape whilst conducting the air from the dirty air inlet to the dirt and dust separating apparatus and then to the clean air outlet of the vacuum cleaner. The air flow path also normally follows a route which forces the air flow path to change direction abruptly or else to expand in cross-sectional area. This is because the shape and cross-sectional area of different portions of the air flow paths are often determined by the relative proportions of different parts of the vacuum cleaner. For example, the portion of the air flow path immediately downstream of the changeover valve which selects the dirty air inlet appropriate to upright cleaning or cylinder cleaning is often significantly larger in cross-section than other portions of the air flow path so that incoming air from either inlet can be accepted into the downstream flow path. These variations in cross-section of the air flow path cause frictional losses resulting in pressure drops within the air flow, which results in reduced performance of the vacuum cleaner. Air flow paths in prior art vacuum cleaners have also included sharp bends and corners, which also contribute to frictional losses and pressure drops.

SUMMARY OF THE INVENTION

It is an object of the present invention to provide a vacuum cleaner in which frictional losses and pressure drops are minimised. It is a further object of the invention to provide a vacuum cleaner having an airflow path which is less prone to blocking and accumulation of dirt and dust than known vacuum cleaners. A still further object is to provide a vacuum cleaner in which the parts of the airflow path which are prone to blocking are more easily accessible than in known vacuum cleaners.

The uniform cross-sectional area of the air flow path ensures that frictional losses and pressure drops are kept to a minimum and that the dust separation apparatus may thus function at maximum efficiency. The preferred circular cross-sectional area of substantially 800 $mm^2$ has been found to be particularly effective when the vacuum cleaner includes dust separation apparatus consisting of a cyclonic separator.

The provision of removable portions housing curved parts of the air flow path allows the user of the apparatus to remove the removable portions should any blockages occur in the said curved portions. The removal of a removable portion gives the user of the apparatus easy access to the air flow path which allows removal of blockages quickly and easily. The removable portions are preferably retained in an operational position with respect to the remainder of the apparatus by quick release fastenings, for example, resilient tabs, to enable an unskilled user of the apparatus to carry out basic maintenance and removal of blockages. This reduces the amount of skilled time required to maintain the apparatus and keeps the apparatus operational for longer periods thus increasing user satisfaction and decreasing the amount of time required for maintenance and repair.

DETAILED DESCRIPTION OF THE DRAWINGS

A preferred embodiment of the apparatus according to the invention will now be described in detail with reference to the accompanying drawings in which.

BRIEF DESCRIPTION OF THE INVENTION

Figure 1:
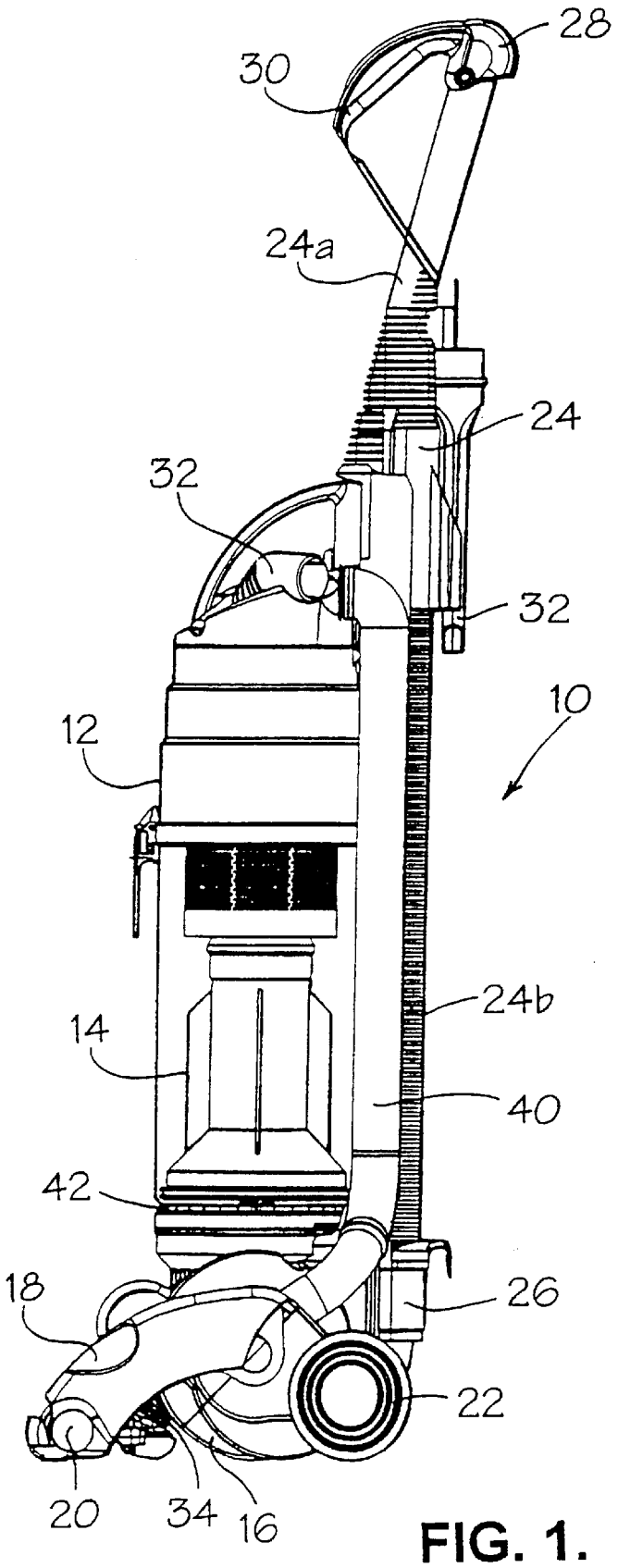
FIG. 1 is a view of a vacuum cleaner according to the invention from one side.
Figure 2:
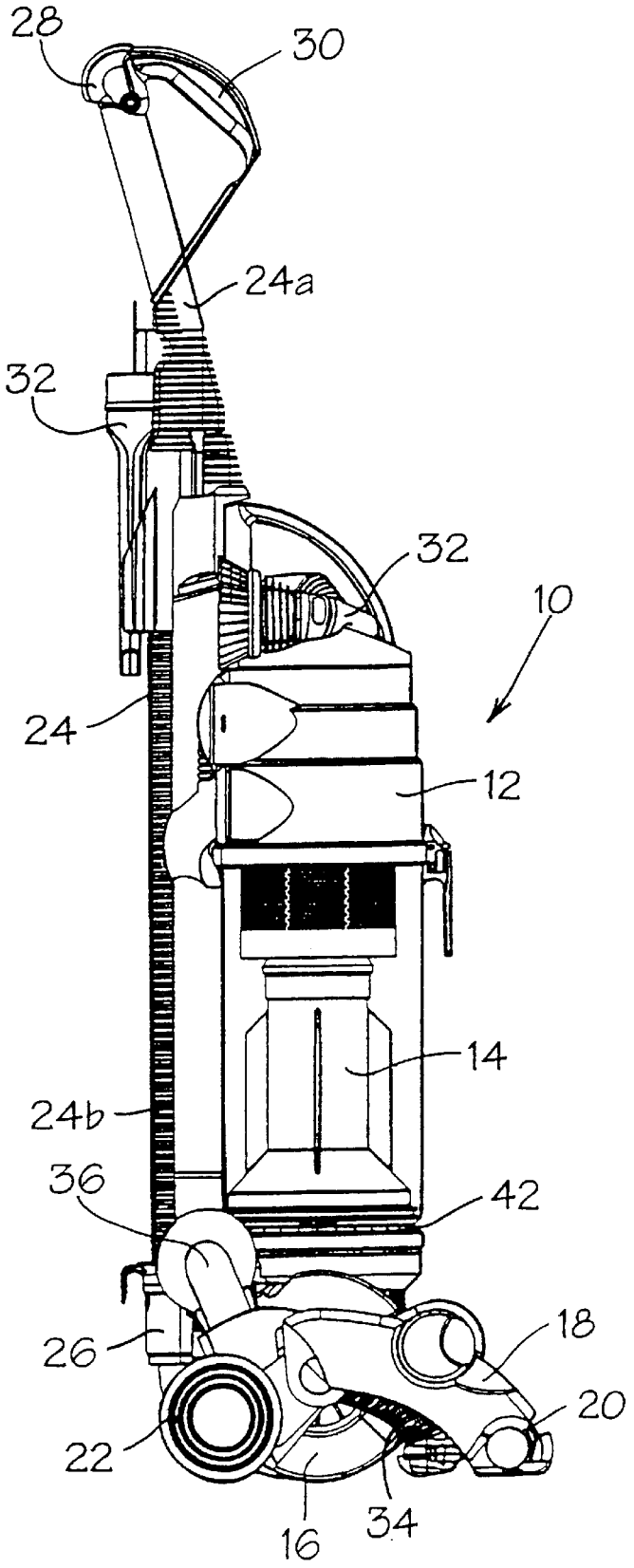
FIG. 2 is a view of from the other side.
Figure 3:
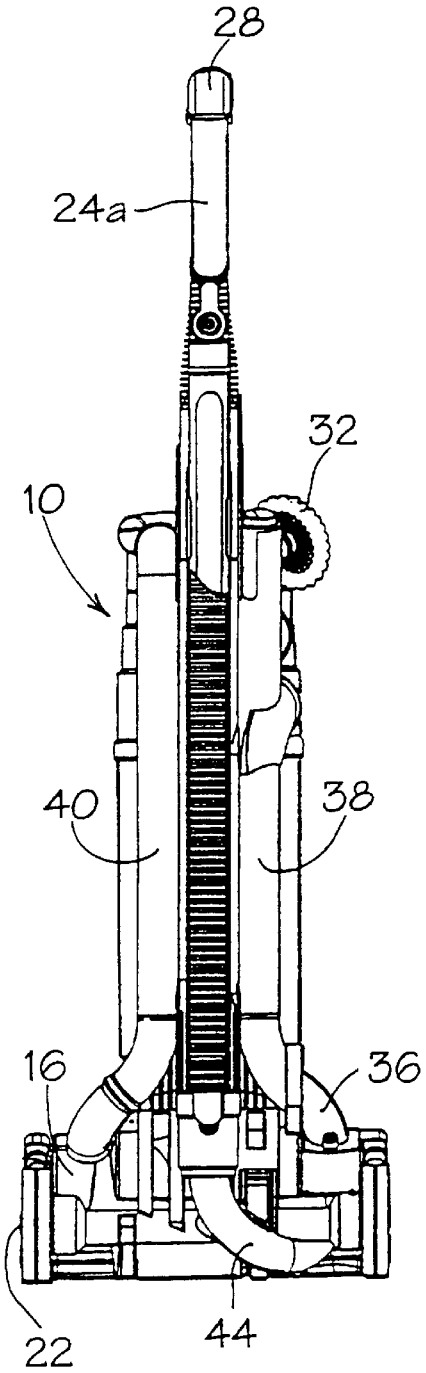
FIG. 3 is a rear view of the vacuum cleaner of FIG. 1.

Referring to FIGS. 1 to 3, a vacuum cleaner 10 according to the invention has a main body 12 in which dust separation apparatus 14 is located. In the illustrated embodiment, the dust separation apparatus comprises two cyclones arranged in series. However, the nature of the dust separation apparatus 14 is not material to the present invention and the separation of dust from the airflow could equally be carried out using other means such as a conventional bag-type filter. A motor housing 16 is located at the lower end of the main body 12 and a cleaner head 18 is rotatably mounted on the motor housing 16. The cleaner head 18 has a brush housing 20 in which a rotatable brush bar is housed for use during upright cleaning. The brush bar is mounted in the mouth of a first dirty air inlet in the cleaner head 18. A motor and fan arrangement (not shown) is housed within the motor housing and support wheels 22 are mounted thereon. Extending upwardly from the motor housing 16 and alongside the main body 12 is a handle 24 which can be released from a socket 26 so as to allow it to be used as a hose/wand structure. The handle 24 consists of a wand 24*a* surrounded by a hose 24*b*. A second air inlet, which is normally closed by a cap 28, is located in the distal end of the wand 24*a* which also carries a hand grip 30. Additional tools 32 are releasably carried on the handle 24 and on the upper end of the main body 12 for use during above floor cleaning. This type of vacuum cleaner, and other similar arrangements, are well known in the marketplace.

The vacuum cleaner 10, as will be understood from the above brief description, has two alternative dirty air inlets; one in the cleaner head 18 and the other at the distal end of the wand 24*a*. The dirty air inlet to be used at any one time will depend upon the mode of operation in which the cleaner 10 is being used. When the cleaner 10 is being used in the upright mode, the operational air inlet is the one in the cleaner head 18. When the cleaner 10 is being used for above the floor cleaning, the air inlet in the distal end of the wand 24*a* is brought into operation. The cleaner 10 incorporates a changeover valve (not shown) which automatically selects the appropriate air inlet in dependence upon the angle of inclination of the handle 24 to the vertical. It will be appreciated that, when the cleaner 10 is to be used in the upright mode, the handle 24 will be inclined to the vertical and, when the cleaner 10 is to be used in the cylinder mode, the handle 24 will be in the vertical position shown in FIGS. 1 and 2.

When the cleaner 10 is to be used in the upright mode, the air inlet in the cleaner head 18 becomes operational. Dirty air is drawn into the brush housing 20 through the inlet. A flexible pipe 34 carries the dirty air from the brush housing 20 through the changeover valve (not shown) and on to a first duct 36. The first duct 36 communicates with a second duct 38 which extends up the rear of the main casing 12 alongside the handle 24 to the upper end of the dirt and dust separating apparatus 14. The dirt and dust separating apparatus 14 comprises two cyclonic separators arranged in series but, since the nature of the separating apparatus is not material to the invention, the exact operation of the cyclonic separator will not be described in full here. Suffice it to say that the inlet to the dirt and dust separating apparatus 14 is located near the upper end thereof and the outlet of the dirt and dust separating apparatus is located immediately above the inlet thereto. A third duct 40 carries air leaving the dirt and dust separating apparatus to the motor casing 16 in which the motor and fan are housed. An air outlet 42 is positioned beneath the lower end of the main casing 12 and internal ducting (not shown) carries air from the motor casing to the outlet 42.

The flexible pipe 34, the first duct 36, the second duct 38 and the third duct 40 are all circular in cross section. They all have a uniform cross-sectional area of substantially 800 $mm^2$, although it is envisaged that cross-sectional areas of between 600 $mm^2$ and 1400 $mm^2$ will be equally effective, particularly for different types of machine. In the embodiment illustrated, the diameter of the airflow path is essentially 32 mm in the portions in which the cross-sectional area is uniform. Also, the flexible pipe 34 and the first, second and third ducts 36, 38, 40 are constructed and arranged so that there are no sharp changes in direction incorporated within the air flow path as a whole. All changes in direction are smoothly curved so that frictional losses in the air flow path are kept to a minimum and pressure drops are reduced. The same is true for the changeover valve which maintains the constant, smooth airflow path just described as the air passes therethrough.

The third duct 40 conveys the airflow to the motor casing 16 so that the airflow can be used to cool the motor. It will be appreciated that the airflow cannot maintain a uniform cross section around the motor. For the purposes of this invention, it is preferred that the motor and fan arrangement be deemed to be placed at the outlet of the flow path and that the intention of the invention is not to maintain the uniformity of the cross-sectional area around the motor whilst the airflow is being used for cooling purposes.

When the cleaner 10 is to be used in the cylinder mode, the handle 24 is released from the socket 26 and the wand 24*a* is extended so that the upper end of the hose 24*b* is in communication with the lower end of the wand 24*a*. The changeover valve shuts off the inlet in the cleaner head 18 and brings the inlet in the distal end of the handle 24 into operation. In this mode, dirty air in drawn into the said inlet and carried down the wand 24*a* and the hose 24*b* to a fourth duct 44 which carries the dirty air to the changeover valve referred to above. From the changeover valve to the clean air outlet, the passage of the air is as described above. The wand 24*a*, the hose 24*b* and the fourth duct 44 all have an essentially constant cross-sectional area of 800 $mm^2$, or an area equivalent to that of the first, second and third ducts 36, 38, 40. Any changes in direction effected by the wand 24*a* or the fourth duct 44 are smooth and do not include sharp corners or abrupt changes in direction. The connection between the wand 24*a* and the hose 24*b* is designed to ensure that the hose does not bend suddenly at the junction, although the flexible nature of the hose inevitably allows some changes in direction to take place.

Figure 4:
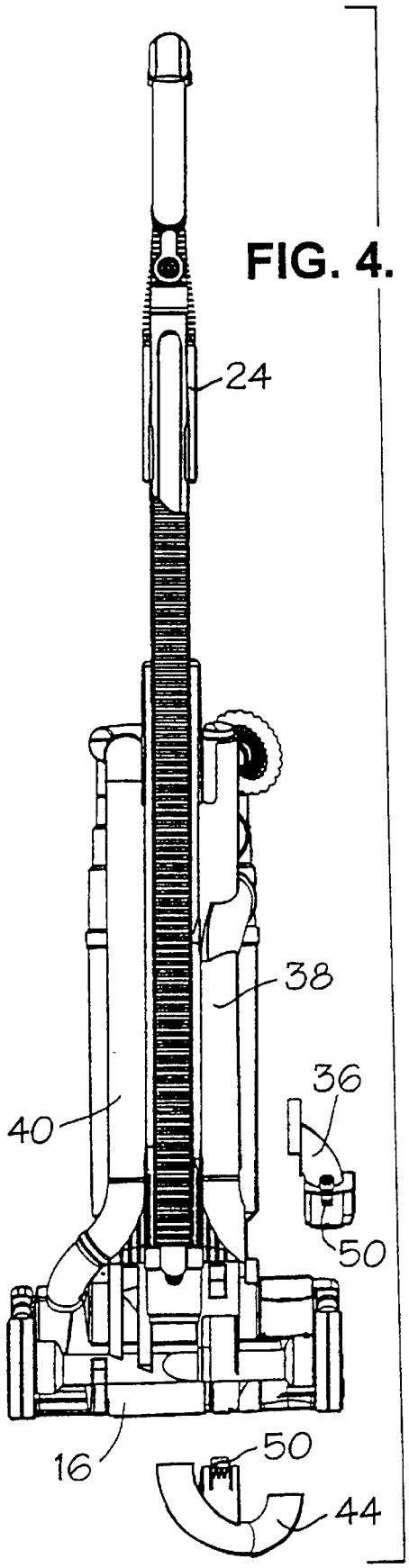
FIG. 4 is a second rear view of the vacuum cleaner of FIG. 1 with two of the removable portions of the air flow path detached.

FIG. 4 shows the cleaner 10 of the present invention with the handle 24 in a semi-extended position, or as it would be when the cleaner 10 is being prepared for above the floor cleaning. The lower end of the wand 24*a* is released from the socket 26 so that the upper end of the hose 24*b* can be slid to the lower end of the wand 24*a*. This, combined with the extendability of the hose itself, allows the user to access areas at a considerable distance from the main body 12 of the cleaner 10. Also shown in FIG. 4 is the removable nature of two portions of the air flow path. The first duct 36 and the fourth duct 44 are each made removable from the cleaner 10 to allow blockages to be easily accessed and removed. Both of the removable portions are positioned upstream of the dust separating apparatus 14 in view of the fact that blockages are less likely to occur downstream of the dust separating apparatus 14.

Each removable duct 36, 44 has a resilient tab or tongue 50 which cooperates with a groove or aperture in or on the main casing 12 (or another non-removable part of the cleaner 10) for releasably attaching the removable duct 36, 44 thereto. A seal is also provided around each end of the portion of the air flow path housed within the respective removable duct 36, 44 to ensure that the connection between that portion within the removable duct and the remainder of the air flow path is essentially airtight. The removable portions 36, 44 are those portions of the air flow path which include the least accessible curves upstream of the dust separating apparatus 14, or those curve or portions of the airflow path which are most prone to blockage. By making these portions removable, the ease with which they can be accessed and unblocked is greatly increased. The snap-fitting connection of the removable portions 36, 44 onto the cleaner 10 means that the removal of the removable portions 36, 44 can be carried out easily and quickly by an unskilled user so that the amount of interruption to normal use of the cleaner 10 is minimal. It will be appreciated that other easily operated connectors can be provided in place of snap-fit connectors: for example, quick-release quarter-turn fasteners can provide equally adequate connections.

The dust separating apparatus 14 is also adapted to be releasable from the main body 12 of the cleaner 10. The main purpose of this is to allow the dust separating apparatus 14 to be emptied periodically. However, the removal of the dust separating apparatus 14 allows the user access to the upper end of the second duct 38 so that any blockages which occur can be easily removed. This, in combination with the removability of the first duct 36, means that the whole of the second duct 38 can be cleared of obstructions should any occur. Removal of the dust separating apparatus 14 also allows access to the upper end of the third duct 40, although the likelihood of blockages occurring downstream of the dust separating apparatus 14 is less than that of blockages occurring upstream thereof.

The clearing of blockages from the hose is also facilitated by the fact that the hose 24*b* is designed to be easily removable from the socket 26 when required by the user. Should the hose 24*b* become blocked, the hose 24*b* can be removed from the socket 26 and accessed from the end which normally resides in the socket 26 in order to remove any blockages. The lower end of the hose will be more prone to blockages than the upper end.

The invention is not limited to the precise details discussed and described above in connection with the illustrated embodiment. Further modifications and variations will be apparent to a skilled reader. For example, it will be appreciated that the essence of the invention is to provide an air flow path which maintains an essentially uniform cross-sectional area between the dirty air inlet and the dust separating apparatus, and between the dust separating apparatus and the outlet of the machine. It is immaterial whether or not a motor and fan unit is placed immediately before the clean air outlet. The invention contemplates that the cross-sectional area of the airflow path will be essentially uniform upstream of the motor and fan unit but will alter as necessary to achieve the cooling effect required for the motor. It will also be understood that, as in a number of known vacuum cleaners, a pre-motor filter may be positioned immediately upstream of the motor to prevent any particles which are not captured by the dust separating apparatus from entering the motor and causing damage thereto. It is not envisaged that the air flow path will have a constant or uniform cross-section through the pre-motor filter, but that the uniform portion of the air flow path will cease immediately before the pre-motor filter. In other arrangements, the pre-motor filter is arranged immediately downstream of the dust separating apparatus and is effectively integral therewith.

What is claimed is:

1. A vacuum cleaner having a first dirty air inlet located in a cleaner head incorporating a brush housing, a clean air outlet, an air flow path extending between the first dirty air inlet and the clean air outlet, dirt and dust separating apparatus lying in the air flow path, a fan and motor unit lying in the air flow path downstream of the dirt and dust separating apparatus, a second dirty air inlet, a conduit extending between the second dirty air inlet and a portion of the air flow path upstream of the dirt and dust separating apparatus, and a changeover valve located and adapted so as to selectively allow dirty air to pass to the dirt and dust separating apparatus from one of the first and second dirty air inlets, characterized that the air flow path and the conduit have a substantially uniform cross-sectional area at all locations between the first dirty air inlet, downstream of the brush housing, and the separating apparatus, between the second dirty air inlet and the separating apparatus, and between the separating apparatus and the fan and motor unit, including through or past the changeover valve.

2. Apparatus as claimed in claim 1, wherein the uniform cross-sectional area of the air flow path and conduit is substantially circular.

3. Apparatus as claimed in claim 1, wherein the uniform cross-sectional area of the air flow path and conduit is between 600 $mm^2$ and 1400 $mm^2$.

4. Apparatus as claimed in claim 3, wherein the uniform cross-sectional area of the air flow path and conduit is substantially 800 $mm^2$.

5. Apparatus as claimed in claim 1, wherein each of the air flow path and conduit comprises a plurality of smooth curves and a plurality of straight portions.

6. Apparatus as claimed in claim 5, wherein any smooth curves forming part of each of the air flow path and conduit upstream of the separating apparatus are housed in removable portions of the apparatus.

7. Apparatus as claimed in claim 1, wherein at least a part of each of the air flow path and conduit is housed within a removable portion of the apparatus to facilitate maintenance.

8. Apparatus as claimed in claim 7, wherein the or each removable portion of the apparatus is releasably attached to a non-removable housing of the apparatus by way of a snap-fit fastening.

9. Apparatus as claimed in claim 8, wherein the snap-fit fastening comprises a resilient member located on the removable portion engageable with a cooperating aperture in the housing.

10. Apparatus as claimed in claim 1, wherein the fan and motor unit is arranged in the air flow path immediately upstream of the clean air outlet.

11. Apparatus as claimed in claim 10, wherein a pre-motor filter is arranged immediately upstream of the motor or immediately downstream of the dirt and dust separating apparatus.

12. Apparatus as claimed in claim 11, wherein the dirt and dust separating apparatus comprises a cyclonic separator.

13. Apparatus as claimed in claim 12, wherein the cyclonic separator comprises two cyclones arranged in series.

14. Apparatus as claimed in claim 10, wherein the vacuum cleaner is an upright vacuum cleaner.

15. Apparatus as claimed in claim 14, wherein the second dirty air inlet is provided in the form of a hose or wand.

* * * * *